US008042525B2

(12) United States Patent
Kobayashi

(10) Patent No.: US 8,042,525 B2
(45) Date of Patent: Oct. 25, 2011

(54) EVAPORATED FUEL TREATING APPARATUS

(75) Inventor: Masahide Kobayashi, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 197 days.

(21) Appl. No.: 12/522,361

(22) PCT Filed: Dec. 28, 2007

(86) PCT No.: PCT/JP2007/075262

§ 371 (c)(1),
(2), (4) Date: Jul. 7, 2009

(87) PCT Pub. No.: WO2008/090720

PCT Pub. Date: Jul. 31, 2008

(65) Prior Publication Data

US 2010/0050995 A1 Mar. 4, 2010

(30) Foreign Application Priority Data

Jan. 26, 2007 (JP) ..... 2007-016533

(51) Int. Cl.
*F02M 33/08* (2006.01)

(52) U.S. Cl. ..... 123/521

(58) Field of Classification Search ..... 123/516, 123/519–521

See application file for complete search history.

(56) References Cited

U.S. PATENT DOCUMENTS 5,280,775 A 1/1994 Tanamura et al.
6,533,002 B1 * 3/2003 Kobayashi et al.
7,152,587 B2 * 12/2006 Suzuki
7,527,045 B2 * 5/2009 Chung ..... 123/519
2002/0078932 A1 6/2002 Weldon et al.
2005/0011499 A1 * 1/2005 Hara et al.

FOREIGN PATENT DOCUMENTS

JP A-2001-140705 * 5/2001
JP A-2002-235609 * 8/2002
JP A-2002-317707 * 10/2002
JP A-2003-314384 * 11/2003
JP A-2004-308483 * 11/2004
JP A-2005-036759 * 2/2005
JP A-2006-118473 * 5/2006

OTHER PUBLICATIONS

Extended Search Report issued in European Application No. EP 07 86 0465 dated Feb. 15, 2011.

* cited by examiner

*Primary Examiner* — Hai Huynh
(74) *Attorney, Agent, or Firm* — Oliff & Berridge, PLC

(57) ABSTRACT

An evaporated fuel treating apparatus that realizes enhanced exertion of the treating capability of a canister for evaporated fuel and thus efficient treatment of evaporated fuel. Vapor piping for feeding an evaporated fuel from fuel tank to canister is provided with first close valve. The first close valve is capable of regulating the flow rate of transit evaporated fuel through regulation of the opening degree thereof. Accordingly, the evaporated fuel treating capability of the canister can be exerted higher than in the system in which the flow rate of evaporated fuel is not regulated.

13 Claims, 2 Drawing Sheets

EVAPORATED FUEL TREATING APPARATUS

BACKGROUND OF THE INVENTION

1. Technical Field

The present invention relates to an evaporated fuel treating apparatus.

2. Background Art

In an evaporated fuel treating apparatus for treating evaporated fuel produced in a fuel tank or the like, it is preferable to treat the evaporated fuel efficiently. For example, in Patent Reference 1, an evaporated fuel treating apparatus is recited in which vapor piping, for feeding evaporated fuel produced in a fuel tank into a canister, is provided with a close valve, and the close valve is put into a closed state when an engine is stopped. Thus, evaporated fuel that is adsorbed in the canister is limited to only evaporated fuel that flows from the fuel tank during refueling.

Realizing enhanced exertion of the evaporated fuel treating capabilities of canisters in actual evaporated fuel treating apparatuses is desired.

Patent Reference 1: Japanese Patent Application Laid-Open (JP-A) No. 2006-118473

DISCLOSURE OF INVENTION

Problem to be Solved by the Invention

Considering the circumstances described above, an object of the present invention is to provide an evaporated fuel treating apparatus that realizes enhanced exertion of the evaporated fuel treating capability of a canister and enables efficient treatment of evaporated fuel.

Means for Solving the Problem

The invention according to a first embodiment includes: a canister that is in fluid communication with a fuel tank and into which evaporated fuel from the fuel tank is fed; and a flow control valve that is provided on feed piping communicating between the fuel tank and the canister and that is capable of regulating a flow rate of the evaporated fuel being fed to the canister from the fuel tank.

In the present invention, the flow rate of the evaporated fuel being fed to the canister through the feed piping from the fuel tank is regulated by the flow control valve. That is, even if a large quantity of evaporated fuel is produced and an excess of evaporated fuel exceeding the evaporated fuel treating capability of the canister is to be fed into the canister, this is restrained. Thus, adsorption efficiency of the canister may be assured. If the excess portion of the evaporated fuel is then fed into the canister, for example, when a production quantity of evaporated fuel is small, when the adsorption capability of the canister has been enhanced by a fall in outside air temperature, or the like, the evaporated fuel treating capability of the canister is exerted higher overall, and efficient treatment of the evaporated fuel is possible.

For example, in a second embodiment, a system in which the evaporated fuel flow rate regulated by the flow control valve is specified so as to be at most a flow rate that is determined such that an evaporated fuel adsorption capability of the canister is not exceeded, the evaporated fuel is fed within a range of adsorption capability of the canister. Further, in a third embodiment, a system in which, the evaporated fuel flow rate regulated by the flow control valve is specified such that adsorption of the evaporated fuel in the canister is performed within a predetermined duration, the evaporated fuel is treated more equally in the predetermined duration (although there is no need for this to be completely uniform) than in a case in which this system is not employed. In addition, as an example, if the predetermined duration is set to 24 hours, then even the night-time, in which the outside air temperature falls, and the like are employed as periods in which the evaporated fuel is adsorbed. With the system of either of the second and third embodiments, enhanced exertion of the evaporated fuel treating capability of the canister is realized and efficient treatment of the evaporated fuel is possible.

The invention according to a fourth embodiment is the invention according to any one of the first to third embodiments, including a communication regulation valve that is provided on atmosphere communication piping, which communicates between the canister and the atmosphere, and that is configured to regulate atmospheric communication of the canister.

This "regulation" by the communication regulation valve includes, beside completely opening or closing the communication regulation valve, regulation to a desired degree of opening. Therefore, the communication regulation valve may be closed and internal pressure of the canister assured. Further, at both a time of adsorption and a time of desorption of evaporated fuel, flows of air in the canister may be regulated: Specifically, in a fifth embodiment, a system in which the communication regulation valve is closed in a range in which an internal pressure of the canister does not exceed a prescribed pressure, the interior of the canister does not get to an excessively high pressure and inadvertent blowing out of evaporated fuel to the canister may be suppressed.

The invention according to a sixth embodiment is the invention according to any one of the first to fifth embodiments, including a tank pressure sensor that detects internal pressure of the fuel tank and a canister pressure sensor that detects internal pressure of the canister, and in which the evaporated fuel flow rate is regulated by the flow control valve in accordance with a pressure difference between the tank internal pressure and the canister internal pressure.

Thus, the evaporated fuel flow rate may be regulated in accordance with not simply the tank internal pressure and the canister internal pressure but also the pressure difference therebetween. For example, by making the opening degree of the flow control valve smaller when the tank internal pressure is relatively high and making the opening degree larger when it is relatively low, the flow rate of evaporated fuel being fed from the fuel tank into the canister may be regulated in a desired range. The flow rate may be prevented from falling any more than necessary in a case in which the tank internal pressure is low.

The invention according to a seventh embodiment is the invention according to claim 6, in which the opening degree of the flow control valve is made larger in a case in which the tank internal pressure is relatively low.

That is, even when the tank internal pressure is in a range higher than the canister internal pressure, if the tank internal pressure is relatively low, the flow rate of evaporated fuel being fed from the fuel tank to the canister is small. In this case, the flow rate can be prevented from falling more than necessary by the opening degree of the flow control valve being made larger.

The invention according to an eighth embodiment is the invention according to the sixth or seventh embodiment, in which the canister and the fuel tank are communicated by the flow control valve in a case in which the tank internal pressure falls below the canister internal pressure.

Thus, it is possible for fuel that has cooled and condensed in the canister to return to the fuel tank.

The invention according to a ninth embodiment is the invention according to any one of the first to eighth embodiments, including an outside air temperature sensor that detects an outside air temperature, and in which the flow control valve is controlled in accordance with the outside air temperature.

Thus, it is possible to feed the evaporated fuel into the canister in correspondence with variations of adsorption capability of the canister due to the outside air temperature.

The invention according to a tenth embodiment is the invention according to claim 9, in which the opening degree of the flow control valve is made smaller when the outside air temperature is relatively high.

The evaporated fuel flow rate is restrained when the adsorption capability of the canister falls in association with a rise in temperature. Thus, more of the evaporated fuel is fed to the canister when the adsorption capability is relatively high, and the overall adsorption capability of the canister is enhanced.

The invention according to an eleventh embodiment is the invention according to any one of the first to tenth embodiments including a cooling apparatus that cools the canister.

The adsorption capability may be improved by cooling the canister with the cooling apparatus.

The invention according to a twelfth embodiment is the invention according to the eleventh embodiment, in which the cooling apparatus is capable of receiving electrical power from an external power source.

Thus, by formation such that the cooling apparatus receives a supply of electrical power from an external power source, electrical discharges of a vehicle-mounted battery may be avoided.

The invention according to a thirteenth embodiment is the invention according to the eleventh or twelfth embodiment, including a tank pressure sensor that detects internal pressure of the fuel tank, and in which the evaporated fuel flow rate regulation by the flow control valve is predicted and the cooling apparatus controlled in accordance with the tank internal pressure.

Therefore, unnecessary driving of the cooling apparatus may be suppressed by cooling the canister at times when cooling is necessary. Further, efficient adsorption of the evaporated fuel is enabled by preparatorily driving the cooling apparatus and cooling the canister before a flow path regulation valve is opened or before the evaporated fuel flow rate is increased by the flow control valve, or the like.

The invention according to a fourteenth embodiment is the invention according to any one of the first to thirteenth embodiments, including supply piping that supplies fuel from the flow control valve to an engine, and in which the flow control valve is a three-way valve capable of switching communication to between the canister and either one of the fuel tank and the engine.

That is, at this three-way valve, communication with the canister fuel tank and communication between the canister and the engine are enabled, but the fuel tank and the engine are not communicated. Therefore, direct purging from the fuel tank into the engine may be avoided.

Effects of the Invention

With the above-described systems, the present invention realizes enhanced exertion of the evaporated fuel treating capability of a canister, and enables efficient treatment of evaporated fuel.

BEST MODE FOR CARRYING OUT THE INVENTION

Figure 1:
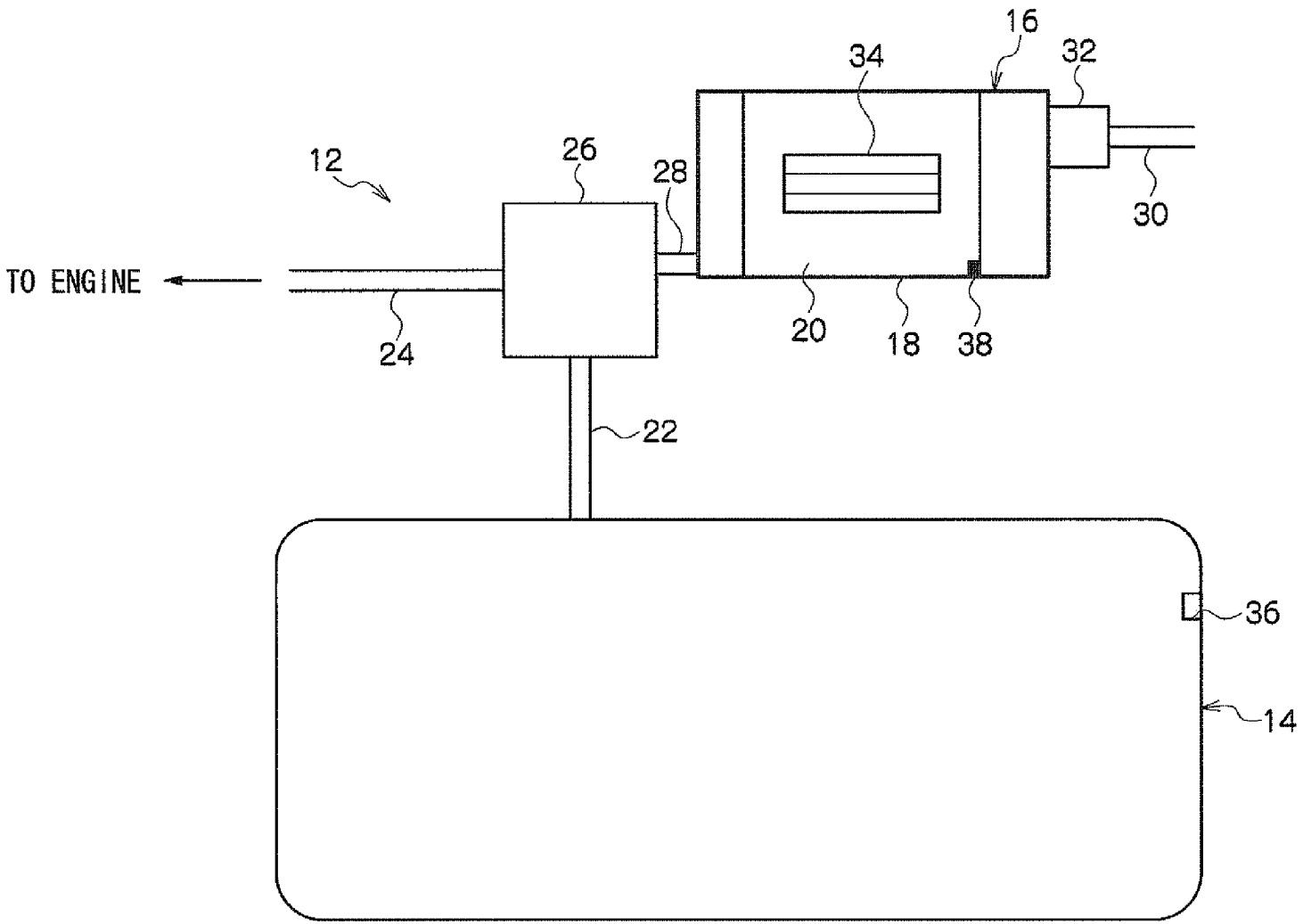
FIG. 1 is a schematic structural view illustrating an evaporated fuel treating apparatus of an exemplary embodiment of the present invention.

FIG. 1 illustrates an evaporated fuel treating apparatus 12 of an exemplary embodiment of the present invention. This evaporated fuel treating apparatus 12 is an apparatus that is employed for treating evaporated fuel produced in a fuel tank 14 or the like, which is mounted at a vehicle, with a canister 16. An adsorbing agent 20, which is constituted to include activated carbon, is accommodated in a canister vessel 18 that structures the canister 16. The evaporated fuel may be adsorbed and desorbed by this adsorbing agent 20.

Herein, the present exemplary embodiment has as an object of application a so-called hybrid vehicle, which is provided with, in addition to an engine, a driving motor that receives a supply of electrical power from a running battery, to serve as driving sources for vehicle running (neither of which is illustrated).

The fuel tank 14 and the canister 16 are connected by vapor piping 22. As will be described later, in the present exemplary embodiment, fuel that has been cooled and condensed in the canister 16 may return to the fuel tank 14, and the structure and state of mounting to the vehicle are such that a fuel tank side port 28 of the canister 16 is at a lowest portion.

Supply piping 24, which is in fluid communication with the unillustrated engine, branches from partway along the vapor piping 22, and a first close valve 26 is provided on the branching portion.

The first close valve 26 is a three-way valve. The present exemplary embodiment, specifically, has a structure in which communication between the canister 16 and the fuel tank 14 and communication between the canister 16 and the engine are possible, but the fuel tank 14 and the engine are not communicated.

Figure 2:
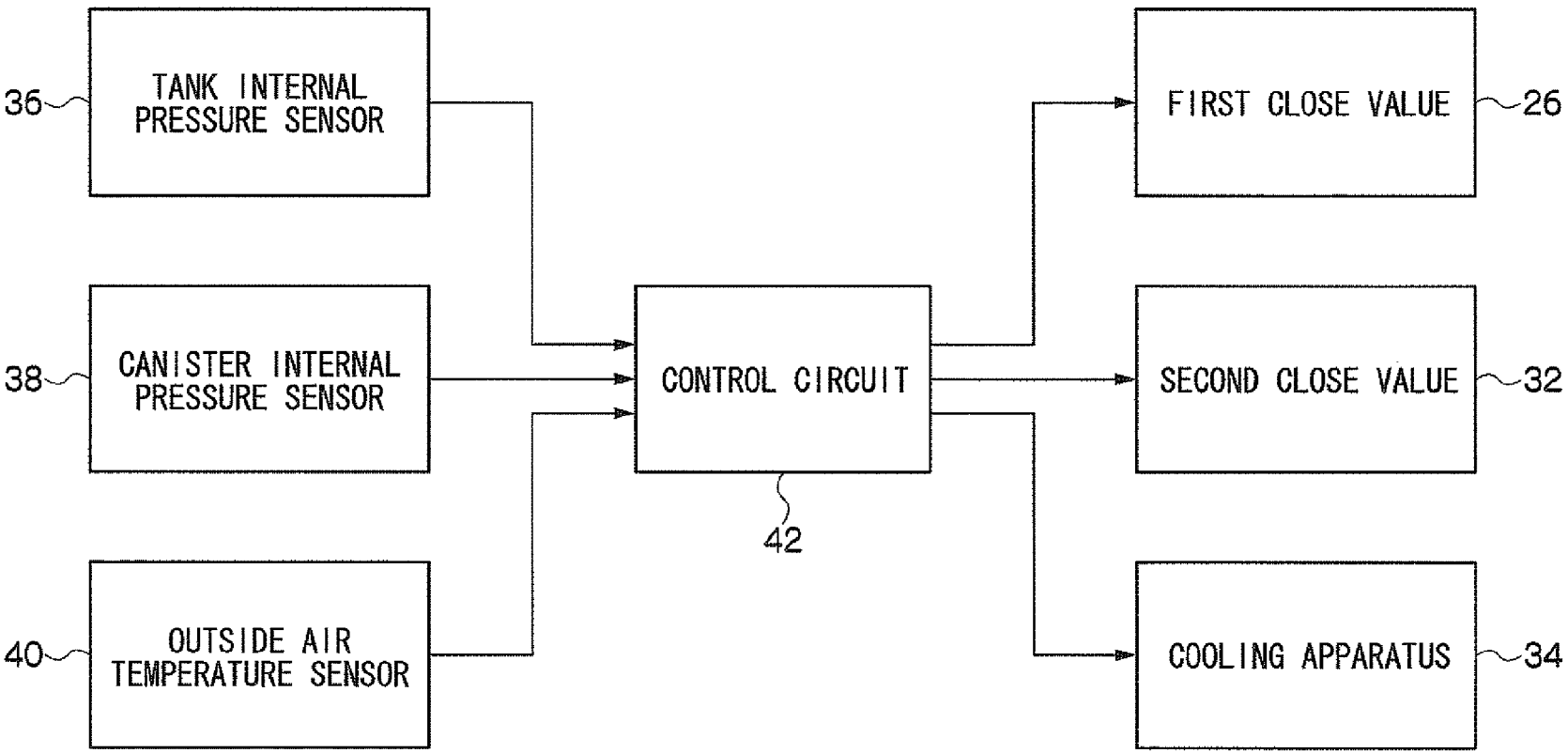
FIG. 2 is a block diagram of the evaporated fuel treating apparatus of the exemplary embodiment of the present invention.

The first close valve 26 opens when internal pressure of the fuel tank 14 (fuel tank internal pressure) is at or above a predetermined pressure which is specified beforehand, and thus communicates between the canister 16 and the fuel tank 14. Hence, by regulating an opening degree (aperture) in at least the state in which the canister 16 and the fuel tank 14 communicate and the state in which the canister 16 and the engine communicate, it is possible to regulate a flow rate of evaporated fuel. Here, as shown in FIG. 2, regulation of the opening degree of the first close valve 26 is implemented by duty control by a control circuit 42.

As shown in FIG. 1, atmosphere communication piping 30, which is in fluid communication with the outside (the atmosphere), is provided at the canister 16. A second close valve 32 is provided on the atmosphere communication piping 30. As shown in FIG. 2, the second close valve 32 is also controlled by the control circuit 42, such that regulation of opening/closing and an opening degree is implemented.

Hence, in the evaporated fuel treating apparatus 12 of the present exemplary embodiment, by regulating respective opening/closing or the opening degree of the first close valve 26 and the second close valve 32, internal pressure of the canister 16 (canister internal pressure) may be maintained at a desired pressure. Accordingly, the canister vessel 18 is constituted to have pressure resistance to withstand only anticipated canister internal pressures.

A cooling apparatus 34, which cools the adsorbing agent 20, is provided inside the canister 16. Ordinarily, with an adsorbing agent that includes activated carbon, the evaporated fuel adsorption capability is enhanced by a drop in temperature (cooling) and the evaporated fuel desorption capability is enhanced by a rise in temperature (heating). The cooling apparatus 34 is also controlled by the control circuit 42, as shown in FIG. 2.

Operation of the cooling apparatus 34 is implemented by a supply of electrical power from an external power source for charging the aforementioned running battery, for example, a household power source.

As shown in FIG. 1, a tank pressure sensor 36, which detects the internal pressure, is provided inside the fuel tank 14. Further, a canister pressure sensor 38, which detects the internal pressure, is provided inside the canister 16. Further yet, an outside air temperature sensor 40 (see FIG. 2), which detects outside air temperature, is provided outside the canister 16. As shown in FIG. 2, the data detected by these sensors is sent to the control circuit 42.

Next, operations and actions of the evaporated fuel treating apparatus 12 of the present exemplary embodiment will be described.

In the evaporated fuel treating apparatus 12 of the present exemplary embodiment, the first close valve 26 is provided at a feeding portion at which evaporated fuel is fed into the canister 16, and the second close valve 32 at a communication portion that communicates with the atmosphere. By controlling these close valves, the canister internal pressure may be maintained in a predetermined range. Further, when evaporated fuel is being fed in through the vapor piping 22 and adsorbed, when atmospheric air is being fed in through the atmosphere communication piping 30 and evaporated fuel is being desorbed (purging), or the like, flows of evaporated fuel, atmospheric air or the like in the respective processes may be controlled.

In the evaporated fuel treating apparatus 12 of the present exemplary embodiment, when the tank internal pressure of the fuel tank 14 is at or above a predetermined pressure which is specified beforehand, the first close valve 26 opens and the canister 16 communicates with the fuel tank 14. At this time, the flow rate of the evaporated fuel being fed from the fuel tank 14 into the canister 16 may be regulated by the first close valve 26. Thus, the evaporated fuel treating capability of the canister 16 may realize enhanced exertion compared to a system in which the flow rate of evaporated fuel is not regulated.

For example, in consideration of the adsorption capability of the canister 16, a method and system which assure adsorption efficiency of the canister 16 by suppressing the flow rate of evaporated fuel from the fuel tank 14 to the canister 16 such that the flow rate is at or below a certain value are exemplified as flow rate regulation of the evaporated fuel by the first close valve 26. That is, in a case in which a large quantity of evaporated fuel is produced inside the fuel tank 14 and an excess of evaporated fuel exceeding the evaporated fuel treating capability of the canister 16 is to be fed into the canister 16, the evaporated fuel flow rate is restrained by the first close valve 26. Thus, the adsorption efficiency of the canister may be assured. If the excess portion of the evaporated fuel is then fed to the canister 16, for example, when a production quantity of evaporated fuel is small, when the adsorption capability of the canister has been enhanced by a fall in the outside air temperature, or the like, the evaporated fuel treating capability of the canister is exerted higher overall, and efficient treatment of the evaporated fuel is possible.

In this case, the flow rate may be prevented from falling any more than necessary when the tank internal pressure is low by, for example, control with the control circuit 42 so as to make the opening degree of the first close valve 26 smaller when the tank internal pressure detected by the tank pressure sensor 36 is relatively high and make this opening degree larger when the tank internal pressure is relatively low.

In this example, in accordance with outside air temperature data detected by the outside air temperature sensor 40, the opening degree of the first close valve 26 may be made smaller when the outside air temperature is high. That is, with the adsorbing agent 20 that is constituted to include activated carbon, the evaporated fuel adsorption efficiency falls in association with a rise in temperature. Therefore, the evaporated fuel flow rate is restrained when the adsorption capability falls, and the evaporated fuel is fed to the canister 16 when the adsorption capability is relatively high. Thus, the overall adsorption capability of the canister 16 is enhanced.

As a different method and system, a predetermined duration may be specified beforehand, and the evaporated fuel produced in the fuel tank 14 adsorbed in the canister 16 within this predetermined duration. For example, the predetermined duration is set to 24 hours and the evaporated fuel flow rate is specified such that a daily evaporated fuel production quantity of the fuel tank 14 is adsorbed by the adsorbing agent 20 of the canister 16 over 24 hours. With this method, the evaporated fuel is sent to the canister 16 and adsorption-treated more equally in the predetermined duration. Naturally, there is no need for the evaporated fuel fed to the canister 16 to be completely uniform in the predetermined duration. That is, the evaporated fuel may be fed to the canister 16 more uniformly over time than in an evaporated fuel treating apparatus in which the system of the present exemplary embodiment is not employed.

In this example, controlling the opening degree of the first close valve 26 with the control circuit 42 is not necessarily required. That is, the first close valve 26 may be a structure of which a maximum opening degree is fixed beforehand such that the evaporated fuel will be adsorbed by the canister 16 over the predetermined duration as described above when the first close valve 26 is at that opening degree.

The above-described two methods and systems relating to the first close valve 26 may each be independently applied, and may be applied in combination.

Further, in the present exemplary embodiment, the cooling apparatus 34 is provided at the canister 16 and cools the adsorbing agent 20 inside the canister 16. Thus, the evaporated fuel adsorption capability may be enhanced. Specifically, the cooling apparatus 34 may be driven at appropriate times in accordance with the tank internal pressure detected by the tank pressure sensor 36. That is, it is anticipated that when the tank internal pressure rises and exceeds a predetermined value, the production quantity of evaporated fuel subsequently increases, and a feeding quantity of evaporated fuel into the canister 16 also increases. Accordingly, the cooling apparatus 34 may be preparatorily driven and cool the adsorbing agent 20 inside the canister 16 at, for example, a time before the first close valve 26 is opened. In addition, when there is no need to cool the adsorbing agent 20 of the canister 16, for example, when the tank internal pressure has not reached the predetermined value and the like, unnecessary driving of the cooling apparatus 34 may be prevented.

Driving of the cooling apparatus 34 may employ an external power source that is for charging the running battery, for example, a household power source, and be implemented by a supply of electrical power from the external power source. Consequently, the supply of electrical power need not be taken from the running battery mounted at the vehicle. Therefore, discharging of the running battery may be prevented. Naturally, in a location without such an external power source, the cooling apparatus 34 may be driven by a supply of electrical power from the running battery. Further, whatever the type of driving power source of the cooling apparatus 34, driving of the cooling apparatus 34 and charging of the running battery may be carried out at the same time.

As described above, in a case of controlling the first close valve 26, the control circuit 42 may prevent emissions due to evaporated fuel fed into the canister 16 being blown out through the atmosphere communication piping 30 when the second close valve 32 is left closed. In this case, both the tank internal pressure and the canister internal pressure may be detected in the present exemplary embodiment, and the first close valve 26 may be controlled with consideration of the difference therebetween.

In the present exemplary embodiment, the canister vessel 18 that has a strength sufficient only to thoroughly withstand anticipated canister internal pressures is used as the canister 16, and the second close valve 32 may be opened as necessary in order to avoid the canister internal pressure exceeding this prescribed value.

In the evaporated fuel treating apparatus 12 of the present exemplary embodiment, the first close valve 26 is a three-way valve, and is capable of switching between communication between the canister 16 and the fuel tank 14 and communication between the canister 16 and the engine. Therefore, when desorption (purging) of evaporated fuel in the canister 16 is possible due to negative pressure from the engine, for example, during engine operation, the first close valve 26 may be switched to communicate between the canister 16 and the engine (the second close valve 32 is kept closed) and the evaporated fuel in the canister 16 provided to the engine. At this time, a purging quantity may be regulated by duty control of the opening degree of the first close valve 26 in accordance with an operational state of the engine.

Further, in a case in which, for example, the tank internal pressure exceeds the predetermined value during vehicle running, the fuel tank 14 and the canister 16 may be put into communication by the first close valve 26 and vapor produced in the fuel tank 14 adsorbed by the adsorbing agent 20 of the canister 16. Hence, when the tank internal pressure falls below the predetermined value, it is thought that the production quantity of evaporated fuel in the fuel tank 14 will become smaller. Thus, the canister 16 and the engine may be put into communication by the first close valve 26 again and evaporated fuel desorbed from the canister 16 by negative pressure of the engine.

In a case in which, for example, the canister internal pressure falls to around atmospheric pressure, the second close valve 32 opens, and desorption of the evaporated fuel may be implemented by a pressure difference between the negative pressure of the engine and atmospheric pressure.

Thus, in the evaporated fuel treating apparatus 12 of the present exemplary embodiment, by appropriately controlling the first close valve 26 and the second close valve 32, the tank internal pressure and the canister internal pressure may be kept high and evaporated fuel directly purged from the fuel tank 14 to the engine. Therefore, an engine purging load may be reduced.

Furthermore, the tank internal pressure may fall below the canister internal pressure due to, for example, a fall in temperature of the fuel tank 14 at night or the like. In such a case, by controlling the first close valve 26 and putting the canister 16 and the fuel tank 14 into communication (and controlling the opening degree of the second close valve 32 as necessary), the fuel that has cooled and condensed in the canister 16 may be returned to the fuel tank 14. Effectively, the evaporated fuel is desorbed (purged) using the negative pressure in the fuel tank 14. Therefore, in this case too, a load of purging by negative pressure from the engine (engine purging) may be reduced. Here, the cooling apparatus 34 may be driven as necessary and the evaporated fuel in the canister 16 more efficiently cooled and condensed.

In the above descriptions, the first close valve 26 and the second close valve 32 are exemplified as the flow control valve and the communication regulation valve of the present invention. However, specific structures of the flow control valve and the communication regulation valve are not particularly limited. Further, control methods of these valves, beside the aforementioned duty control, may be suitably selected in accordance with types of the valves and the like.

However, as the first close valve 26, a three-way valve is preferable, being switchable between communication between the canister 16 and the fuel tank 14 and communication between the canister 16 and the engine.

EXPLANATION OF REFERENCE NUMERALS

12 Evaporated fuel treating apparatus
14 Fuel tank
16 Canister
18 Canister vessel
20 Adsorbing agent
22 Vapor piping (feed piping)
24 Supply piping
26 First close valve (flow control valve)
28 Fuel tank side port
30 Atmosphere communication piping
32 Second close valve (communication regulation valve)
34 Cooling apparatus
36 Tank internal pressure sensor
38 Canister internal pressure sensor
40 Outside air temperature sensor
42 Control circuit

The invention claimed is:

1. An evaporated fuel treating apparatus comprising:

a canister that is in fluid communication with a fuel tank and into which evaporated fuel from the fuel tank is fed; and a flow control valve that is provided on feed piping communicating between the fuel tank and the canister and that is capable of regulating a flow rate of the evaporated fuel being fed to the canister from the fuel tank, wherein the evaporated fuel flow rate regulated by the flow control valve is specified such that adsorption of the evaporated fuel in the canister is performed within a predetermined duration.

2. The evaporated fuel treating apparatus according to claim 1, wherein the evaporated fuel flow rate regulated by the flow control valve is specified so as to be at most a flow rate that is determined such that an evaporated fuel adsorption capability of the canister is not exceeded.

3. The evaporated fuel treating apparatus according to claim 1, comprising a communication regulation valve that is provided on atmosphere communication piping, which communicates between the canister and the atmosphere, and that is configured to regulate atmospheric communication of the canister.

4. The evaporated fuel treating apparatus according to claim 3, wherein the communication regulation valve is closed in a range in which an internal pressure of the canister does not exceed a prescribed predetermined pressure.

5. The evaporated fuel treating apparatus according to claim 1, comprising an outside air temperature sensor that detects an outside air temperature, wherein the flow control valve is controlled in accordance with the outside air temperature.

6. The evaporated fuel treating apparatus according to claim 5, wherein an opening degree of the flow control valve is made smaller when the outside air temperature is relatively high.

7. The evaporated fuel treating apparatus according to claim 1, comprising supply piping that supplies fuel from the flow control valve to an engine, wherein the flow control valve is a three-way valve capable of switching communication to between the canister and either one of the fuel tank and the engine.

8. An evaporated fuel treating apparatus comprising:

a canister that is in fluid communication with a fuel tank and into which evaporated fuel from the fuel tank is fed;

a flow control valve that is provided on feed piping communicating between the fuel tank and the canister and that is capable of regulating a flow rate of the evaporated fuel being fed to the canister from the fuel tank;

a tank pressure sensor that detects internal pressure of the fuel tank; and a canister pressure sensor that detects internal pressure of the canister, wherein an opening degree of the flow control valve is made larger in a case in which the tank internal pressure is relatively low.

9. The evaporated fuel treating apparatus according to claim 8, wherein the evaporated fuel flow rate is regulated by the flow control valve in accordance with a pressure difference between the tank internal pressure and the canister internal pressure.

10. An evaporated fuel treating apparatus comprising:

a canister that is in fluid communication with a fuel tank and into which evaporated fuel from the fuel tank is fed;

a flow control valve that is provided on feed piping communicating between the fuel tank and the canister and that is capable of regulating a flow rate of the evaporated fuel being fed to the canister from the fuel tank;

a tank pressure sensor that detects internal pressure of the fuel tank; and a canister pressure sensor that detects internal pressure of the canister, wherein the canister and the fuel tank are communicated by the flow control valve in a case in which the tank internal pressure falls below the canister internal pressure.

11. The evaporated fuel treating apparatus according to claim 10, wherein the evaporated fuel flow rate is regulated by the flow control valve in accordance with a pressure difference between the tank internal pressure and the canister internal pressure.

12. An evaporated fuel treating apparatus comprising:

a canister that is in fluid communication with a fuel tank and into which evaporated fuel from the fuel tank is fed;

a flow control valve that is provided on feed piping communicating between the fuel tank and the canister and that is capable of regulating a flow rate of the evaporated fuel being fed to the canister from the fuel tank;

a cooling apparatus that cools the canister; and a tank pressure sensor that detects internal pressure of the fuel tank, wherein the evaporated fuel flow rate regulation by the flow control valve is predicted and the cooling apparatus controlled in accordance with the tank internal pressure.

13. The evaporated fuel treating apparatus according to claim 12, wherein the cooling apparatus is capable of receiving electrical power from an external power source.

* * * * *